US011877646B2

(12) United States Patent
Scafini

(10) Patent No.: US 11,877,646 B2
(45) Date of Patent: Jan. 23, 2024

(54) WORK SURFACE ATTACHMENT MECHANISM, ARTICLE OF FURNITURE, AND METHOD OF MAKING THE ARTICLE OF FURNITURE

(71) Applicant: Knoll, Inc., East Greenville, PA (US)

(72) Inventor: Mark P. Scafini, East Greenville, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 17/860,161

(22) Filed: Jul. 8, 2022

(65) Prior Publication Data

US 2023/0008493 A1 Jan. 12, 2023

Related U.S. Application Data

(60) Provisional application No. 63/220,749, filed on Jul. 12, 2021.

(51) Int. Cl.
*A47B 13/02* (2006.01)
*A47B 21/02* (2006.01)

(52) U.S. Cl.
CPC ..... *A47B 13/021* (2013.01); *A47B 21/02* (2013.01); *A47B 2220/0002* (2013.01)

(58) Field of Classification Search
CPC .. A47B 13/021; A47B 2013/022; A47B 21/02
See application file for complete search history.

(56) References Cited

U.S. PATENT DOCUMENTS

| | | | | |
|---|---|---|---|---|
| 2,821,450 | A | | 1/1958 | Knoll |
| 4,248,325 | A | | 2/1981 | Georgopoulos |
| 4,325,597 | A | | 4/1982 | Morrison |
| 4,382,642 | A | | 5/1983 | Burdick |
| 4,546,889 | A | | 10/1985 | Schoumaker et al. |
| 4,567,698 | A | | 2/1986 | Morrison |
| 4,604,955 | A | | 8/1986 | Fleischer et al. |
| D318,389 | S | * | 7/1991 | Hawkinson ..... D6/709 |
| 5,086,597 | A | | 2/1992 | Kelley et al. |
| 5,224,429 | A | | 7/1993 | Borgman et al. |
| 5,287,909 | A | | 2/1994 | King et al. |
| 5,309,686 | A | | 5/1994 | Underwood et al. |
| 5,328,260 | A | | 7/1994 | Beirise |
| 5,408,940 | A | | 4/1995 | Winchell |
| 5,562,052 | A | | 10/1996 | Glashouwer et al. |
| 5,598,789 | A | | 2/1997 | Jonker |

(Continued)

FOREIGN PATENT DOCUMENTS

| | | | | |
|---|---|---|---|---|
| DE | 20216700 U1 | * | 2/2003 | ..... A47B 13/021 |
| DE | 202014002411 U1 | * | 2/2015 | ..... A47B 13/021 |

*Primary Examiner* — Daniel J Rohrhoff

(74) *Attorney, Agent, or Firm* — Buchanan Ingersoll & Rooney PC

(57) ABSTRACT

An article of furniture can include a work surface attachment mechanism that is configured to adjustably connect a work surface to a base of the article. The work surface attachment mechanism can be incorporated into one or more legs and be configured to facilitate attachment of different work surfaces of different thicknesses to the base for supporting the work surface above a floor. The work surface attachment mechanism can be adjustable to facilitate such functionality while avoiding large sized gaps that can detract from the aesthetic effect of the article or the base of the article.

17 Claims, 9 Drawing Sheets

(56) References Cited

U.S. PATENT DOCUMENTS

| | | | | |
|---|---|---|---|---|
| 5,675,946 | A | 10/1997 | Verbeek et al. | |
| 5,680,893 | A | 10/1997 | Neer | |
| 5,706,739 | A | 1/1998 | Shaheen et al. | |
| 5,715,761 | A | 2/1998 | Frattini | |
| 5,881,979 | A | 3/1999 | Rozier, Jr. et al. | |
| 5,906,420 | A | 5/1999 | Rozier, Jr. et al. | |
| 5,941,182 | A | 8/1999 | Greene | |
| 5,943,966 | A | 8/1999 | Machado et al. | |
| 5,966,879 | A | 10/1999 | Verbeek et al. | |
| 6,000,180 | A | 12/1999 | Goodman et al. | |
| 6,002,613 | A | 12/1999 | Cloud et al. | |
| 6,029,587 | A | 2/2000 | Rozier, Jr. et al. | |
| 6,067,762 | A | 5/2000 | Greer et al. | |
| D427,783 | S | 7/2000 | Luedke | |
| 6,167,664 | B1 | 1/2001 | Reuter et al. | |
| D457,359 | S | 5/2002 | Chan | |
| 6,389,988 | B1 | 5/2002 | Frattini | |
| D458,040 | S | 6/2002 | Stannis et al. | |
| 6,536,567 | B2 | 3/2003 | Hiestand | |
| 6,546,880 | B2 | 4/2003 | Agee | |
| 6,896,028 | B2 | 5/2005 | Brennan | |
| 7,310,918 | B1 | 12/2007 | Reuter et al. | |
| 7,789,025 | B2 | 9/2010 | Michaud, II et al. | |
| 8,056,489 | B2 | 11/2011 | Nielsen | |
| D653,862 | S | 2/2012 | Hairston | |
| 8,132,371 | B2 | 3/2012 | Golinski et al. | |
| 8,256,359 | B1 | 9/2012 | Agee | |
| 8,347,796 | B2 | 1/2013 | Udagawa et al. | |
| 8,365,798 | B2 | 2/2013 | Feldpausch et al. | |
| 8,667,909 | B2 | 3/2014 | Ruzicka | |
| 9,265,340 | B2 | 2/2016 | Krusin et al. | |
| 9,585,468 | B2 | 3/2017 | Udagawa et al. | |
| 9,730,513 | B2 | 8/2017 | Udagawa et al. | |
| D796,216 | S | 9/2017 | Rockwell et al. | |
| D800,459 | S | 10/2017 | Rockwell et al. | |
| 9,920,520 | B2 | 3/2018 | Udagawa et al. | |
| 10,390,611 | B2 | 8/2019 | Lee | |
| 10,413,063 | B2 | 9/2019 | Lee | |
| 10,610,009 | B1 * | 4/2020 | Ciputra | A47B 13/021 |
| 2005/0126452 | A1 * | 6/2005 | Ziakin | A47B 13/021 108/156 |
| 2012/0126072 | A1 | 5/2012 | Pettersson | |
| 2012/0304441 | A1 | 12/2012 | Henriott | |
| 2013/0204438 | A1 | 8/2013 | Hjelm | |
| 2017/0226749 | A1 | 8/2017 | Fjetland | |
| 2019/0365089 | A1 | 12/2019 | Lee | |

* cited by examiner

WORK SURFACE ATTACHMENT MECHANISM, ARTICLE OF FURNITURE, AND METHOD OF MAKING THE ARTICLE OF FURNITURE

CROSS-REFERENCE TO RELATED APPLICATIONS

This patent application claims priority to U.S. Provisional Patent Application No. 63/220,749, filed on Jul. 12, 2021. The entirety of this application is incorporated by reference herein.

FIELD

The present innovation relates to articles of furniture (e.g. tables, desks, etc.) and methods of making articles of furniture.

BACKGROUND

Examples of tables and table arrangements can be appreciated from U.S. Patent Application Publication Nos. 2019/0365089, 2013/0204438 and 2012/0126072 and U.S. Pat. Nos. 10,413,063, 10,390,611, 9,585,468, 9,265,340, 8,667,909, 8,256,359, 8,056,489, 6,546,880, 6,536,357, 6,389,988, 6,029,587, 5,941,182, 5,881,979, 5,715,761, 5,706,739, 5,598,789, 5,562,052, 5,224,429, 5,408,940, and 4,604,955. Examples of other types of articles of furniture can be appreciated from U.S. Pat. Nos. 9,920,520, 8,365,798, 7,789,025, 7,310,918, 6,896,028, 6,367,213, 6,002,613, 6,000,180, 5,966,879, 5,675,946, 5,680,893, 5,287,909, 4,325,597, 4,248,325, and 2,821,450, U.S. Design Pat. Nos. D800,459, D796,216, D653,862, D458,040, D457,359, and D427,783 and U.S. Patent Application Publication Nos. 2017/0226749 and 2012/0304441.

Examples of furniture systems that can be used in organizing or decorating interior spaces of buildings such as offices or homes can be appreciated from U.S. Pat. Nos. 9,730,513, 8,347,796, 8,132,371, 6,167,664, 6,067,762, 5,943,966, 5,906,420, 5,328,260, 5,309,686, 5,086,597, 4,567,698, 4,546,889, 4,382,642, 4,325,597, and 2,821,450.

SUMMARY

I have determined that there is a need for an article of furniture and work surface attachment mechanism for articles of furniture (e.g. desks, tables, counters, etc.) For example, work surfaces (e.g. tabletops, desktops, and other work surfaces) can often have limited means for attachment to a base e.g. legs, an array of legs, a pedestal base, etc.) to support the work surface at a desired position. Such limited attachment means can often limit the aesthetic options for designing of an article having a work surface (e.g. a table, a desk, etc.). I determined that a new work surface attachment mechanism can be provided that can facilitate an improved work surface attachment feature for use in articles of furniture and methods of making and using an article of furniture (e.g. table, desk, etc.) that can help provide an improved aesthetic effect for designs of such articles while also permitting fabrication to occur in a relatively simple, cost-efficient manner that can also permit installation to occur quickly and easily. In some embodiments, shipping and installation can be facilitated so that components of the article can be shipped in a single box or a limited number of boxes in a relatively compact manner. In such embodiments, no mechanical tools may be required for installation, only a single type of tool may be required for installation (e.g. a single wrench or screw driver), or only a limited number of tools may be required to help facilitate installation and allow installation to occur relatively quickly after the boxed components of the article are delivered.

In some embodiments, a work surface attachment mechanism for an article of furniture can include at least one leg (e.g. a first leg, a second leg, a third leg, a fourth leg, up to four legs, more than four legs, etc.). Each leg can have an upper portion having a component contacting surface defining a cavity. A linearly extending elongated member can be rotatably positionable within the cavity. A lower clamping member support body can be moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member. A jaw comprising an upper clamping member can be moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member. The jaw can be moveable to adjust a size of a mouth for receipt of a peripheral edge portion of a work surface and clamping engagement therewith.

In some embodiments, the lower clamping member support body can have a tubular portion attached to the linearly extending elongated member or can be attached to a tubular portion attached to the linearly extending elongated member. The tubular portion can have a threaded channel through which the linearly extending elongated member passes so that threads of the linearly extending elongated member mate with threads of the threaded channel so that rotation of the linearly extending elongated member drives motion of the tubular portion along the linearly extending elongated member.

Some embodiments can include an outer casing member attached to the upper clamping member. The outer casing member can have a projection that is slideable within a groove defined in the component contacting surface. The projection can be slideable within lower end of the groove and the upper end of the groove to define a bottom position of the jaw and a top position of the jaw. The jaw can include the outer casing member and the jaw can be moveable between the top position and the bottom position without rotating in some embodiments.

Embodiments of the jaw can include a guide mechanism to guide motion of the upper clamping member along the upper surface of the lower clamping member support body. The upper surface of the lower clamping member support body can be ramped at an angle relative to horizontal that is within a pre-selected range of 15°-75°.

An article of furniture can include a base, a work surface supported by the base, and a work surface attachment mechanism. The work surface attachment mechanism can include a linearly extending elongated member rotatably positionable within a cavity of a component of the base and a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member. A jaw comprising an upper clamping member that is moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member. The jaw can be moveable to adjust a size of a mouth for receipt of a peripheral edge portion of the work surface and clamping engagement therewith.

In some embodiments of the article of furniture, the component of the base can be a leg of the base. Each leg of the base can include a work surface attachment mechanism.

In some embodiments, the article of furniture can be a table or a desk and the work surface can be a tabletop or a desktop.

In some embodiments of the article of furniture, the lower clamping member support body has a tubular portion attached to the linearly extending elongated member or is attached to a tubular portion attached to the linearly extending elongated member. The tubular portion can have a threaded channel through which the linearly extending elongated member passes so that threads of the linearly extending elongated member mate with threads of the threaded channel so that rotation of the linearly extending elongated member drives motion of the tubular portion along the linearly extending elongated member.

Embodiments of the jaw of the work surface attachment mechanism can include an outer casing member attached to the upper clamping member. The outer casing member can have a projection that is slideable within a groove defined in the component of the base. The projection can be slideable within lower and upper ends of the groove to define a bottom position of the jaw and a top position of the jaw. The jaw can be moveable between the top position and the bottom position without rotating.

In some embodiments, the jaw can include a guide mechanism to guide motion of the upper clamping member along the upper surface of the lower clamping member support body.

Embodiments can be structured so that the upper surface of the lower clamping member support body can be ramped at an angle relative to horizontal that is within a pre-selected range of 15°-75°.

Embodiments of a method for installing an article of furniture are also provided. Some embodiments of the method can include providing a work surface, a base, and a work surface attachment mechanism, positioning a linearly extending elongated member within a cavity of a component of the base so the linearly extending elongated member is rotatable, and attaching a lower clamping member support body to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member. Embodiments of the method can also include connecting an upper clamping member of a jaw to the lower clamping member support body so that the upper clamping member is moveably attached to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member. The jaw can be moveable to adjust a size of a mouth for receipt of a peripheral edge portion of the work surface and clamping engagement therewith. Embodiments of the method can also include moving the jaw to a bottom position for positioning a peripheral edge portion of the work surface in a mouth of the work surface attachment mechanism and moving the jaw toward a top position to engage the peripheral edge portion of the work surface in the mouth to clamp the peripheral edge portion of the work surface to the component of the base for attachment of the work surface to the base.

The component of the base can be a leg of the base or another type of base component. In some embodiments, the work surface can be a tabletop or a desktop.

Embodiments of the method can utilize an embodiment of the article of furniture and/or embodiment of the work surface attachment mechanism for an article of furniture.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of an article of furniture and exemplary embodiments of components of the article including exemplary embodiments of a work surface attachment mechanism included in the article are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
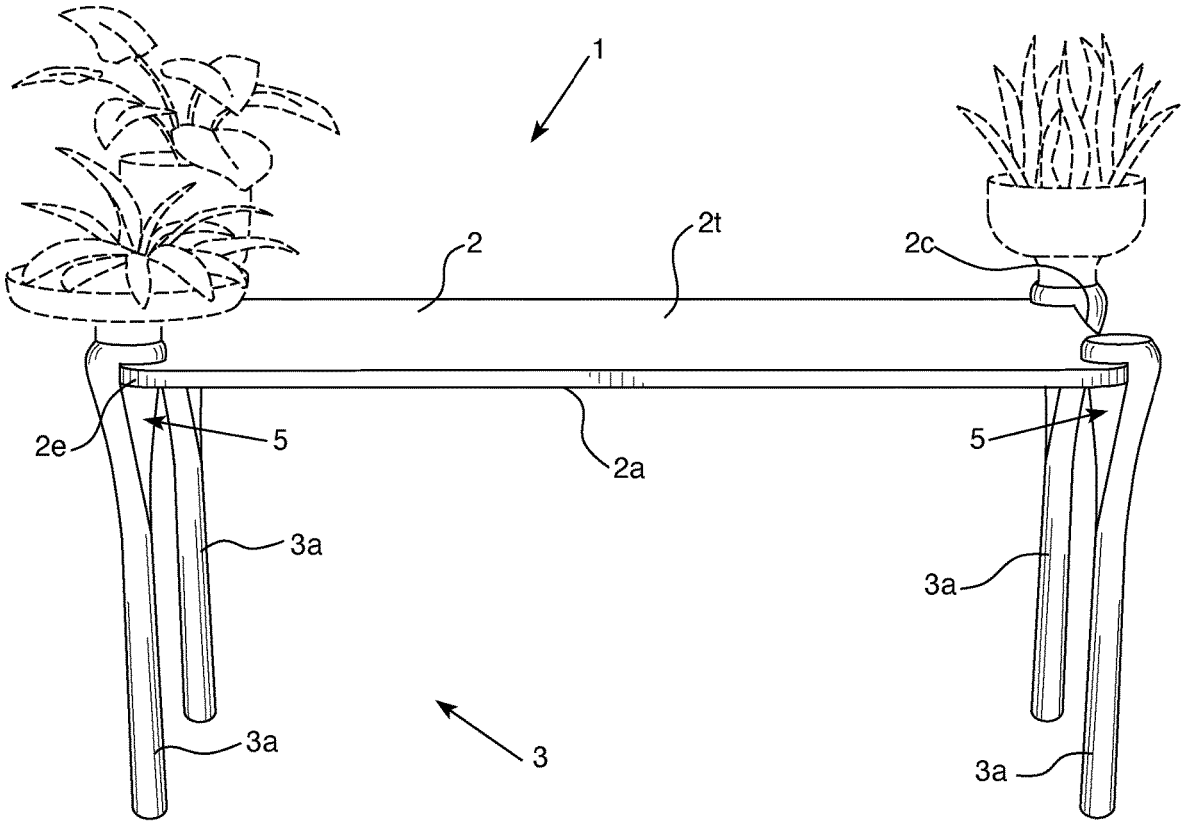
FIG. 1 is a perspective view of a first exemplary embodiment of an article of furniture.
Figure 2:
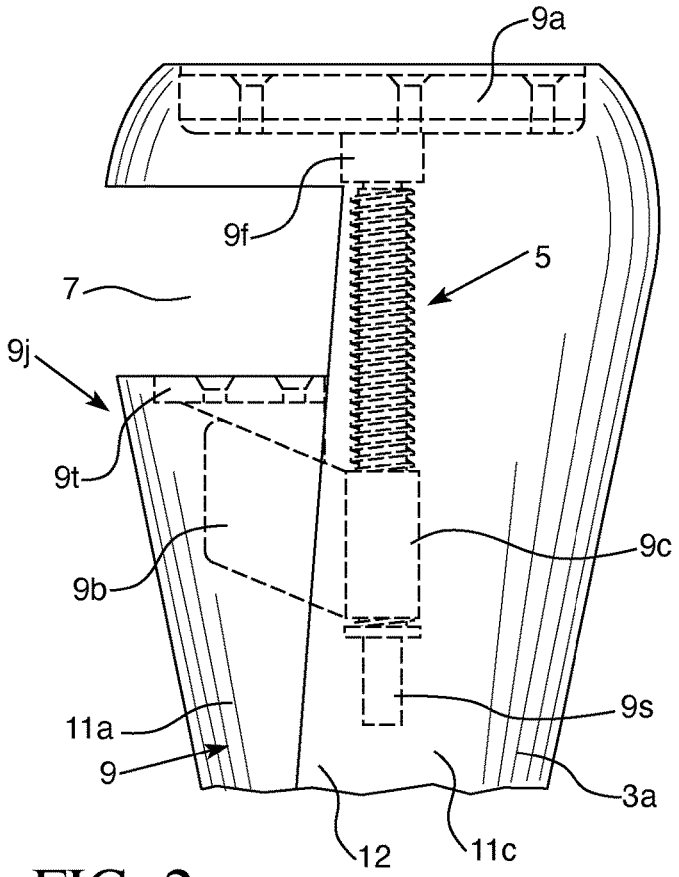
FIG. 2 is a fragmentary view of an exemplary embodiment of a leg of the first exemplary embodiment of the article of furniture illustrating an exemplary embodiment of a work surface attachment mechanism in a first position.
Figure 3:
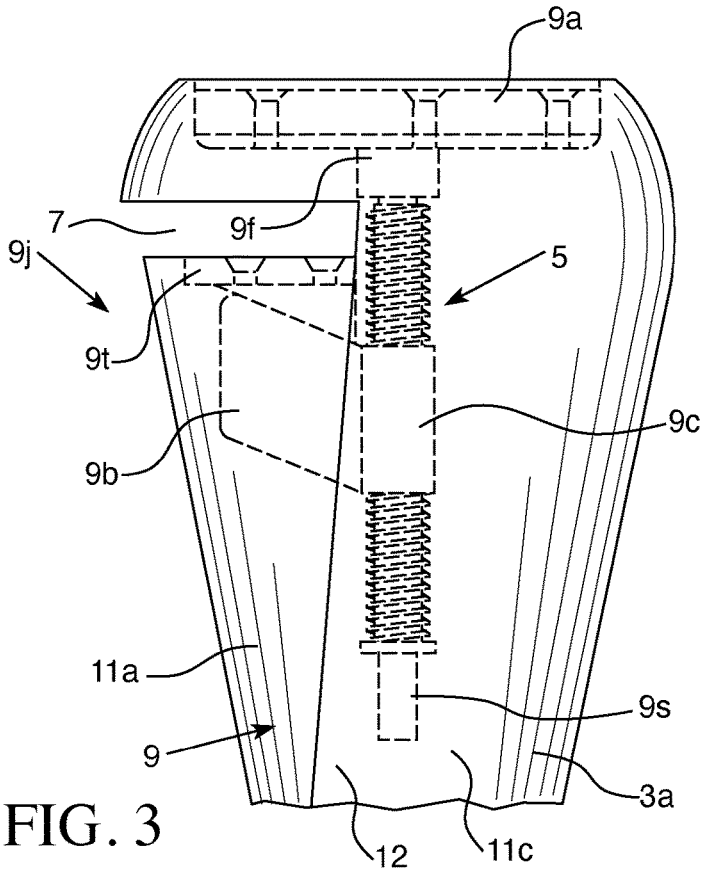
FIG. 3 is a fragmentary view of an exemplary embodiment of the leg of the first exemplary embodiment of the article of furniture illustrating an exemplary embodiment of a work surface attachment mechanism in a second position.
Figure 4:
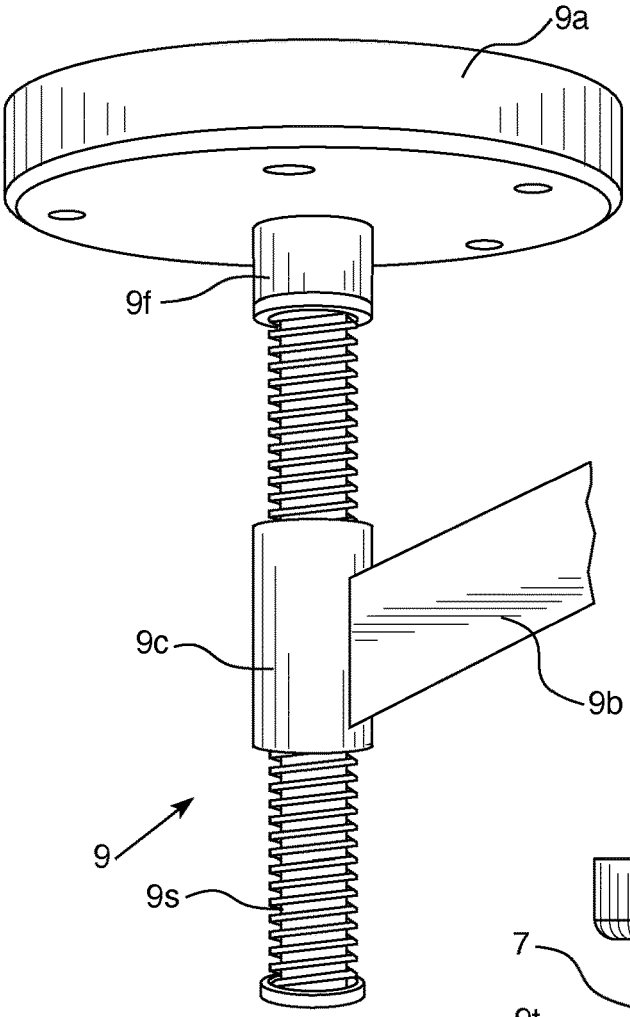
FIG. 4 is a perspective view of components of the exemplary embodiment of the work surface attachment mechanisms that can be included in the first exemplary embodiment of the article of furniture.
Figure 5:
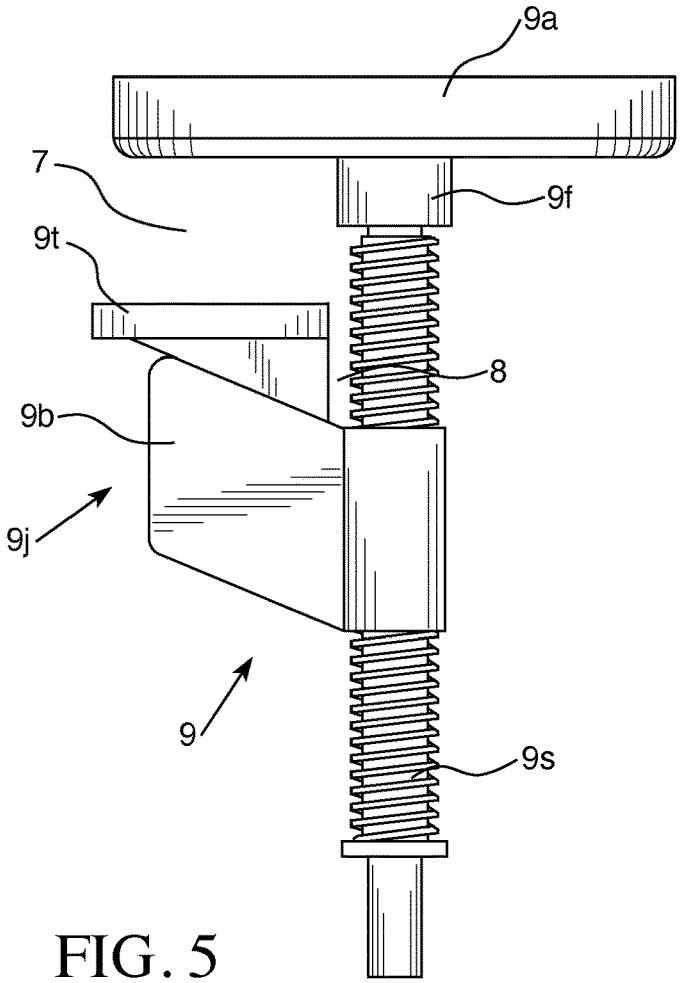
FIG. 5 is a schematic side view of the exemplary embodiment of work surface attachment mechanisms that can be included in the first exemplary embodiment of the article of furniture with the mechanism in the second position.

Referring to FIGS. 1-10, an article of furniture 1 can include a base 3 that supports a work surface 2. The article of furniture 1 can be structured as a table, a desk, or a counter and the work surface can be a tabletop, desktop, or countertop, for example. It is contemplated that other embodiments of the article of furniture 1 can be another type of furniture structure (e.g. chair, privacy screen structure, etc.).

The work surface 2 can be a plate-type structure having a polygonal (e.g. rectangle, square, hexagonal, trapezoidal, etc.), oval, circular, or irregular shape. The work surface 2 can include a top 2*t* and a bottom opposite the top 2*t* of the work surface 2. The bottom and top 2*t* can extend on bottom and top faces of the work surface 2 between one or more peripheral edges, which can include a front edge 2*a*, a right side edge 2*e*, a left side edge 2*c*, and a rear edge opposite the front edge 2*a*. The peripheral edges can surround a perimeter of the work surface and be the outermost edges. In some embodiments, the front, rear, right, and left sides can be sides of a single continuous peripheral edge of the work surface (e.g. circular or oval shaped work surfaces, etc.). In other embodiments, there may be specifically defined front, rear, left, and right side peripheral edges (e.g. polygonal shaped work surfaces, rectangular or square shaped work surfaces, etc.).

The work surface 2 can be positioned above a floor by a base 3 that is configured to support the work surface 2. The base 3 can be connected to the work surface by at least one work surface attachment mechanism 5 or by an array of work surface attachment mechanisms 5. The array of work surface attachment mechanisms can include at least two work surface attachment mechanisms, at least four work surface attachment mechanisms, or another number of work surface attachment mechanisms 5 (e.g. three, five, six, seven, eight, etc.). The base 3 can include a pedestal base arrangement or include one or more legs 3*a*. In some embodiments, there can be a plurality of legs 3*a*. The legs can include at least two legs, at least three legs, at least four legs, or more than four legs. The legs 3*a* can have a lower end that can include a foot or be attached to a foot (e.g. a castor, a glide, etc.). The upper end of each of the legs can be positioned adjacent the bottom of the work surface 2 and be located above the lower end of the leg 3*a*. Each leg can include a work surface attachment mechanism 5 attached to the upper end portion of the leg 3*a* and/or positioned in the upper end portion of the leg 3*a*.

The work surface attachment mechanism 5 that is incorporated into the upper portion of each leg 3*a* may be best seen from FIGS. 2-10. Each work surface attachment mechanism 5 can include a moveable clamping device 9 that is adjustable to change the size of a mouth 7 sized to receive a peripheral edge portion of the work surface and also adjust a size of a gap 8 that is between an upper clamping member 9*t* and a linearly extending elongated member 9*s* at the same time the size of the mouth 7 is being adjusted. A jaw 9*j* of the moveable clamping device can be adjustable between top and bottom positions for adjusting the size of the mouth 7.

The moveable clamping device 9 can include an upper body 9*a* and an elongated member receiving tube 9*f* that has a channel defined therein that is sized and configured so an upper end portion of the linearly extending elongated member 9*s* is passable through the channel of the elongated member receiving tube 9*f* and positionable within a hole defined in the upper body 9*a*. The upper body 9*a* can have a circular or disk like shape in some embodiments. In other embodiments, the upper body 9*a* can have a polygonal shape, oval shape, or other type of shape. The elongated member receiving tube 9*f* can be cylindrically or pipe-like in shape or can have a polygonal cross-section (e.g. be hexagonal or rectangular in cross-sectional shape, have a polygonal cross-sectional shape, etc.). In some embodiments, the elongated member receiving tube 9*f* can be a tubular projection extending downwardly from the upper body 9*a* or be a downwardly projecting body attached to the upper body 9*a*. In yet other embodiments, the upper body 9*a* may not include or be attached to an elongated member receiving tube 9*f* and this component may be omitted from the moveable clamping device 9. For example, in some embodiments, the thickness of the upper body 9*a* may be sufficient and use of an elongated member receiving tube 9*f* may not be needed to help facilitate positioning of the linearly extending elongated member 9*s*.

Figure 10:
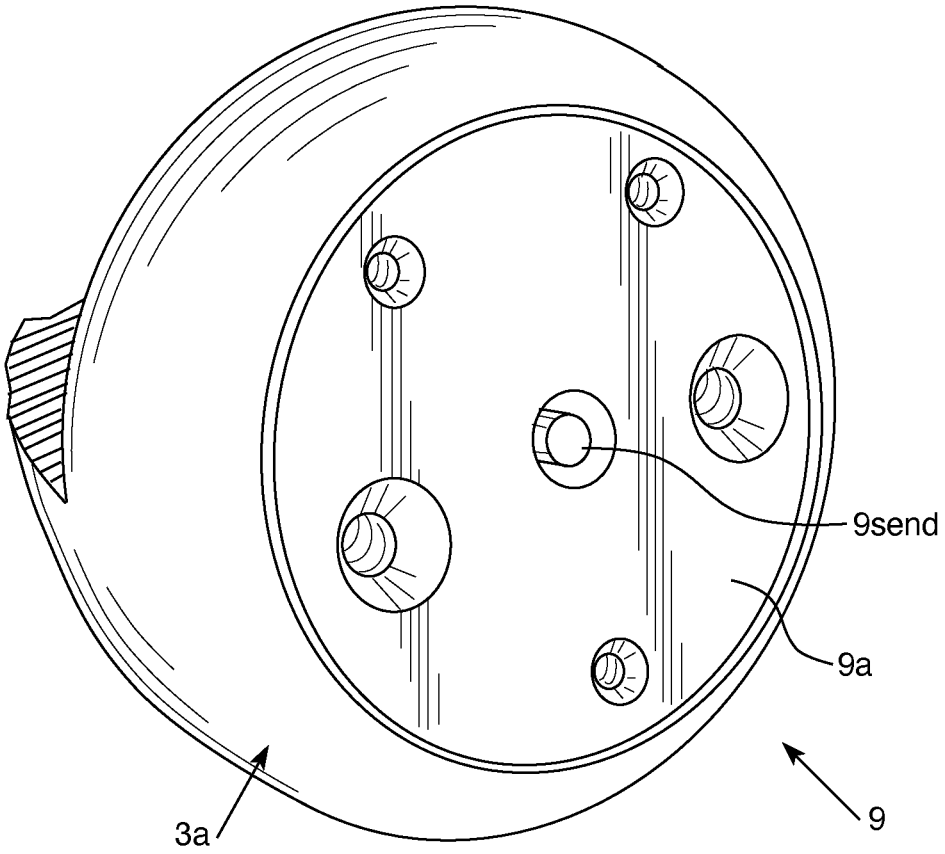
FIG. 10 is a top view of the exemplary embodiment of a leg of the first exemplary embodiment of the article of furniture illustrating an exemplary embodiment of a work surface attachment mechanism positionable therein.

As may best be appreciated from FIG. 10, the upper end 9*send* of the linearly extending elongated member 9*s* can be positionable within a hole of the upper body 9*a*. This hole can be a central hole or other hole defined in the upper body 9*a*. The upper end 9*send* of the linearly extending member 9*s* can be positioned so that a screw driver or wrench can be used to engage the linearly extending elongated member 9*s* to rotate the linearly extending member 9*s*. In yet other embodiments, the upper end 9*send* of the linearly extending member 9*s* can have an interference fit within the hole of the upper body 9*a* so that rotation of the upper body can cause the linearly extending elongated member 9*s* to rotate. In yet other embodiments, the moveable clamping device 9 can be configured so that upper body 9*a* is positionable in the upper portion of a leg 3*a* to help retain the linearly extending elongated member 9*s* within the leg after the jaw 9*j* has been positioned for engagement with the peripheral edge portion of a work surface via rotation of the linearly extending elongated member 9*s* via use of an installer's hand or use of a mechanical tool (wrench, hex wrench, Allen wrench, screwdriver, etc.).

Figure 9:
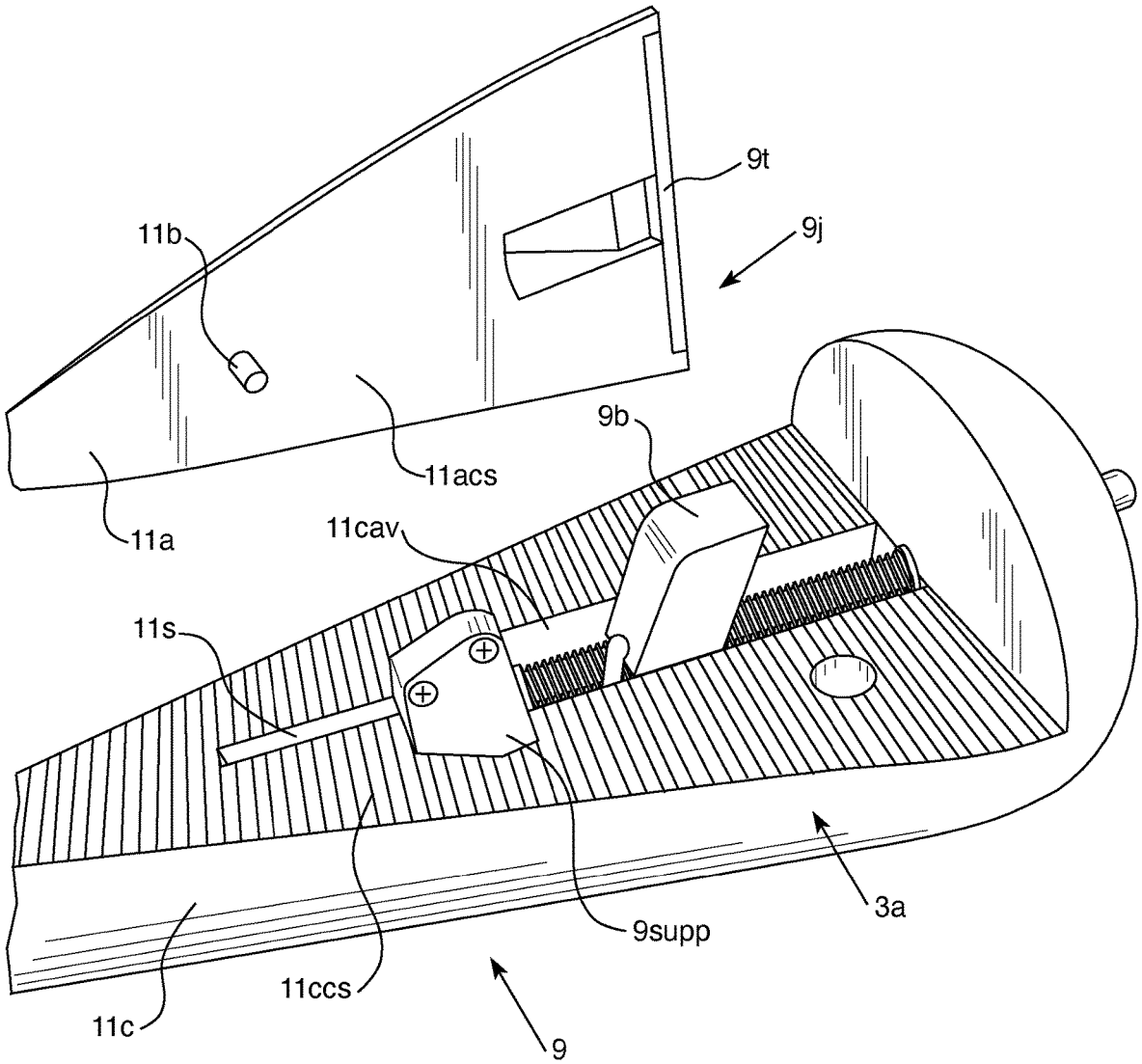
FIG. 9 is an exploded view of an exemplary embodiment of a leg of the first exemplary embodiment of the article of furniture illustrating an exemplary embodiment of a work surface attachment mechanism positionable therein.

As may best be seen from FIG. 9, the lower end of the linearly extending elongated member 9*s* can be positioned within a lower support 9*supp* that is attachable within the leg 3*a* so the lower end of the linearly extending elongated member 9*s* is rotatable within the lower support 9*supp*. For instance, the lower end of the linearly extending elongated member 9*s* can be rotatably positionable within a hole defined in the lower support 9*supp*. The leg 3*a* can be sized and configured to include a cavity 11*cav* that is defined to receive the lower support 9*supp* for attachment therein (e.g. via fasteners). The cavity 11*cav* can be an opening defined in the leg 3*a* (e.g. defined in the outer component facing surface 11*ccs* of the leg 3*a*). The cavity 11*cav* can be shaped and sized for positioning of the linearly extending elongated member 9*s* and facilitate moveable attachment with the outer casing member 11*a* via the upper clamping member 9*t* being positioned on or slideably attachable to a lower clamping member support body 9*b* that is moveably attached to the linearly extending elongated member 9*s* so that rotation of the linearly extending elongated member 9*s* causes the lower clamping member support body 9*b* to move along the length of the linearly extending elongated member 9*s*.

The outer casing member 11*a* can include at least one projection 11*b* that is sized and configured to be slideably received within a groove 11*s* defined in the first portion 11*c* of the upper portion of the leg 3*a*. The groove 11*s* can be defined in an outer component facing surface 11*ccs* of the upper portion of the leg 3*a*. The groove 11*s* can be separated from the cavity 11*cav* or be in communication with the cavity 11*cav*. The groove 11*s* can have a length that defines the path of travel between the top and bottom positions of the jaw 9*j* to help limit vertical adjustable motion of the jaw 9*j*. The groove's upper and lower ends defined in the body of the first portion 11*c* of the upper portion of the leg 3*a* can each be shaped to contact the projection 11*b* to prevent further slideable motion of the projection 11*b* within the groove 11*s* to prevent further motion of the upper clamping member 9*t* and outer casing member 11*a* to which it is attachable, to define bottom and top positions of the jaw 9*j*, for example.

The leg 3*a* can be formed or otherwise structure so that the leg 3*a* includes the lower support 9*supp* so the lower support 9*supp* is defined in a position that is in communication with a cavity 11*cav* that is sized to receive and retain the linearly extending elongated member 9*s* so the lower end of the linearly extending elongated member 9*s* can be rotatably received within a hole defined in the lower support 9*supp*. The hole of the lower support 9*supp* can have a mouth that is open on the top of the lower support 9*supp* to receive and retain the lower end of the linearly extending elongated member 9*s*.

The outer casing member 11*a* can have an outer surface that is to help define a shape of the leg 3*a*. A portion of the outer surface of the outer casing member 11*a* can be a leg facing surface 11*acs* that is positioned to face and/or also slide along an outer component facing surface 11*ccs* of the first portion 11*c* of the leg 3*a* (e.g. a portion of the upper portion of the leg 3*a* or an entirety of the upper portion of the leg 3*a*). The outer component facing surface 11*ccs* can face toward the leg facing surface 11*acs* when the outer casing member 11*a* is moveably connected to the leg 3*a* via the upper clamping member 9*t* being attached to and/or positioned on the lower clamping member support body 9*b*.

The moveable clamping device 9 can be configured so that the moveable jaw 9*j* is moveable vertically and is also moveable horizontally during adjustable motion so that the jaw 9*j* can move upwardly and inwardly (e.g. horizontally toward the leg 3*a*) when the jaw 9*j* is moved upwardly to make the size of the mouth 7 smaller for clamping engagement with a peripheral edge portion of the work surface. The moveable clamping device 9 can also be configured so that the moveable jaw 9*j* is moveable vertically and is also moveable horizontally during adjustable motion so that the jaw 9*j* can move downwardly and outwardly (e.g. horizontally away from the leg 3*a*) when the jaw is moved downwardly to make the size of the mouth 7 larger for releasing or receiving the peripheral edge portion of the work surface. Such vertical and horizontal motion can permit the jaw 9*j* to move along an upper portion of leg 3*a* that has a tapered outer shape (e.g. increases in thickness along the height of the leg 3*a* so that the leg 3*a* is thicker at its top as compared to a lower portion of the leg 3*a* and the thickness of the leg 3*a* continuously increases along its height form the thinner lower portion to the thicker higher portion).

The jaw 9*j* can include a upper clamping member 9*t* that is slideably positioned on a lower clamping member support body 9*b* that is moveably connected to the linearly extending elongated member 9*s* that can define a path of travel for the jaw 9*j* or help define this path of travel in conjunction with projection 11*b* and groove 11*s*. In some embodiments, the lower clamping support body 9*b* can include a tubular portion 9*c* or be attached to a tubular portion 9*c*. For example, the tubular portion 9*c* can be integral to the lower clamping support body 9*b* (e.g. a molded integral portion of the body, a cast integral portion of the body) or be attached to the lower clamping support body 9*b* via at least one fastening mechanism (e.g. welding, one or more fasteners, adhesive, etc.)

The tubular portion 9*c* can have a threaded central channel so that the body of the linearly extending elongated member 9*s* can pass through the tubular portion 9*c*. Threads on the outer surface of the linearly extending elongated member 9*s* can mate with the threads of the threaded central channel of the tubular portion so that the lower clamping support body is moveable between a top position and a bottom position along a path of travel defined by the threads of the linearly extending elongated member 9*s*. As may best be appreciated from FIGS. 2-3 and 5-8, there can be a number of different intermediate positions at which the lower clamping support body 9*b* and upper clamping member 9*t* can be positioned along the path of travel between the bottom and top positions. As discussed above, the top and bottom positions along the path of travel defined by the linearly extending elongated member 9*s* can be defined by the projection 11*b* of the outer casing member 11*a* to which the upper clamping member 9*s* is attached and the groove his that receives the projection 11*b* defined in the leg 3*a*.

It should be appreciated that the top position of the jaw 9*j* can be considered a first position and the bottom position of the jaw 9*j* can be considered a second position. Alternatively, the bottom position of the jaw 9*j* can be considered a first position and the top position of the jaw 9*j* can be considered a second position. Intermediate positions of the jaw 9*j* located between the top and bottom positions can be considered additional other positions (e.g. a third position, at least one third position, third, fourth, fifth, and sixth positions, etc.).

The threaded central channel of the tubular portion 9*c* can be configured to mate with threads on the linearly extending elongated member 9*s* so that rotation of the linearly extending elongated member 9*s* can cause the tubular portion 9*c* to move upwardly along the linearly extending member without rotating or with minimal rotation. Upward motion of the tubular portion 9*c* can cause the body support portion 9*b* attached to the tubular portion 9*c* as well as the upper clamping member 9*t* that is moveably attached to or positioned on the lower clamping member support body 9*b* to move along the path of motion for adjusting the size of the mouth 7 without rotating or with minimal rotation. For instance, rotation of the linearly extending elongated member 9*s* in a first rotational direction (e.g. clockwise or counterclockwise) can cause the jaw 9*j* to move upwards along the linearly extending elongated member without the jaw 9*j* rotating (e.g. without rotation of the tubular portion 9*c*, without rotation of the lower clamping member support body 9*b*, and without rotation of the upper clamping member 9*t*). Rotation of the linearly extending elongated member 9*s* in a second rotational direction that is opposite the first rotational direction (e.g. clockwise if the first rotational direction is counterclockwise or counterclockwise if the first rotational direction is clockwise) can cause the jaw 9*j* to move downwards along the linearly extending elongated member without the jaw 9*j* rotating (e.g. without rotation of the tubular portion 9*c*, without rotation of the lower clamping member support body 9*b*, and without rotation of the upper clamping member 9*t*).

The upper portion of the leg 3*a* can include a first portion 11*c* that is sized and shaped to define an inner cavity 11*cav* or other opening that therein for positioning and retention of the linearly extending elongated member 9*s*. The leg 3*a* can be shaped and sized so that the outer casing member 11*a* is attachable thereto or positionable in tight relation therewith to enclose the cavity 11*cav* after the linearly extending elongated member 9*s* is positioned therein or is rotatably positioned therein. Connection between the upper clamping member 9*t* attachable to the outer casing member 11*a* and the upper portion of the leg 3*a* can be provided and/or facilitated by the upper clamping member 9*t* being attached to or positioned on the lower clamping member support body 9*b*. This connection can also be facilitated by the projection 11*b* of the outer casing member 11*a* being received within the groove 11*s* defined in the upper portion of the leg 3*a* in combination with the positioning and/or attachment of the upper clamping member 9*t* to the top of the lower clamping member support body 9*b* (e.g. to the upper surface of the lower clamping member support body 9*b*).

The outer casing member 11*a* can be shaped so that when it is connected to the first portion 11*c* of the upper portion of the leg 3*c*, the outer casing member 11*a* helps define an outer shape of the upper portion of the leg 3*a* that is moveable along the leg 3*a* to help define the jaw 9*j*. The upper clamping member 9*t* can be attached to the outer casing member 11*a* via an interference fit within an opening defined in the body of outer casing member 11*a*, via a mateable interlock between the upper clamping member 9*t* and an opening of the body of the outer casing member 11*a* shaped to receive and retain the upper clamping member 9*t* at a top of the outer casing member, via at least one fastener, via adhesive, via welding, or via a combination of such fastening mechanisms. The upper clamping member 9*t* can also be attached to the outer casing member 11*a* via a different type of attachment mechanism or combination of such mechanisms.

The upper clamping member 9*t* can be a portion of the jaw 9*j*. the upper clamping member 9*t* can be positioned to directly contact the peripheral edge portion of the work surface positionable within the mouth 7 via adjustable motion of the upper clamping member 9*t* when connected to the upper portion of the outer casing member 11*a* so that the upper clamping member 9*t* can engage the portion of the work surface 2 for attachment of the work surface 2 to the leg 3*a*. An upper part of the mouth 7 can be defined by a top portion of the leg 3*a* or an upper portion of the clamping device 9 that defines or helps define the upper portion of the mouth 7.

There can be a seam 12 that is defined between the outer casing member 11*a* and the upper portion of the leg 3*a* to which it is moveably attached. This seam 12 can be a small indentation or defined line-like space (e.g. a gap or groove or space that looks like a line) at a peripheral interface between the outer casing member 11*a* and upper portion of the leg 3*a* located where the outer component facing surface 11*ccs* contacts the leg facing surface 11*acs* of the outer casing member 11*a*. There can be seems 12 defined along opposite peripheral sides of the leg 3*a* and outer casing member 11*a* (e.g. a first seam 12 at a left or rear side and a second seam 12 at a right or front side, etc.).

Referring to FIGS. 2-3 and 5-8, the adjustable movement of the jaw 9*j* can also be configured to adjust a size of a gap 8 between the upper clamping member 9*t* and the linearly extending elongated member 9*s*. The upward motion of the jaw 9*j* can result in the upper clamping member 9*t* moving toward the linearly extending elongated member 9*s* along an upper surface of the lower clamping member support body 9*b* to make the gap 8 smaller (as indicated for example by arrows JM in FIG. 8). The downward motion of the jaw 9*j* can result in the upper clamping member 9*t* moving away from the linearly extending elongated member 9*s* along the upper surface of the lower clamping member support body 9*b* to make the gap 8 larger. The motion of the upper clamping member 9*t* can also cause the outer casing member 11*a* to move horizontally toward the leg 3*a* during vertical movement upwards and move horizontally away from the leg 3*a* during vertical downward motion via its connection to the upper clamping member 9*t* and the upper clamping member's motion. This horizontal motion of the outer casing member 11*a* facilitated via the motion of the upper clamping member 9*t* along the upper surface of the lower clamping member support body 9*b* can keep the seam 12 to a small size and keep the outer component facing surface 11*ccs* of the leg 3*a* in contact with the leg facing surface 11*acs* of the outer casing member 11*a* during vertical motion of the outer casing member 11*a* when the outer casing member 11*a* moves upwards as well as when the outer casing member 11*a* moves downwards. This function can help improve an aesthetic effect of the article 1 by avoiding an undesired gap between the outer casing member 11*a* and the leg 3*a*. The avoidance of such a gap can also avoid creating a possible pinch point that could affect the finger of a user that may get stuck therein and pinched during installation and adjustment of the clamping device 9, installation of the article 1, or attachment of the work surface 2 to one or more of the legs 3*a* or base 3.

The upper surface of the lower clamping member support body 9*b* can define a ramp along which the upper clamping member 9*t* can move during height adjustment of the jaw 9*j* (and upper clamping member 9*t*) that is driven via rotation of the linearly extending elongated member 9*s*. The ramped surface can be declined at an angle θ that is in a pre-selected range of inclination, which can be, for example, 15°-75°, or 45°-60°. The angle of inclination can be an angle at which the ramped upper surface extends relative to horizontal from an inner position adjacent the linearly extending elongated member 9*s* and an outer position located farther away from the linearly extending elongated member 9*s* and above this inner position.

The ramped upper surface of the lower clamping member support body 9*b* and the bottom surface of the upper clamping member 9*t* can be configured to provide a guide mechanism GM to help guide motion of the upper clamping member 9*t* along the ramped surface and/or help facilitate moveable attachment of the upper clamping member 9*t* to the lower clamping member support body 9*b*. For example, such a guide mechanism GM can include the ramped upper surface of the lower clamping member support body 9*b* being defined so that there is a groove that can receive a projection downwardly extending from the upper clamping member 9*t* to be received in this groove to help guide the motion of the upper clamping member 9*t* along the upper surface of the lower clamping member support body 9*b*. As another example of the guide mechanism GM, the lower clamping member support body 9*b* can include an elongated protrusion 9*bp* thereon that extends upwardly from the ramped upper surface to be positionable within a slot 9*tgs* defined in a bottom portion of the upper clamping member 9*t* to help guide motion of the upper clamping member 9*t* along the upper ramped surface of the lower clamping member support body 9*b*.

In other embodiments, it is contemplated that the guide mechanism GM can include the upper clamping member 9*t* having a slot defined in its bottom that can receive an upwardly projecting protrusion that extends upwardly from an upper surface of the lower clamping member support body 9*b* (e.g. a top of the lower clamping support body 9*b*). In yet other embodiments, the guide mechanism can utilize a different type of guide feature to help guide motion of the upper clamping member 9*t* along the upper surface of the lower clamping member support body 9*b*.

Each upper clamping member 9*t* can include one or more grip elements to help facilitate a secure clamp to the work surface 2 when the work surface is within the mouth 7 and the upper clamping member 9*t* is moved to its tightened position that clamps a peripheral portion of the work surface 2 positioned within the mouth 7 via the upper portion of the leg 3*a* and the upper surface of the upper clamping member 9*t*. Each grip element 9*c* can be configured to increase an amount of friction induced by motion of the work surface 2 to provide a more secure clamped connection with the work surface 2.

Figure 6:
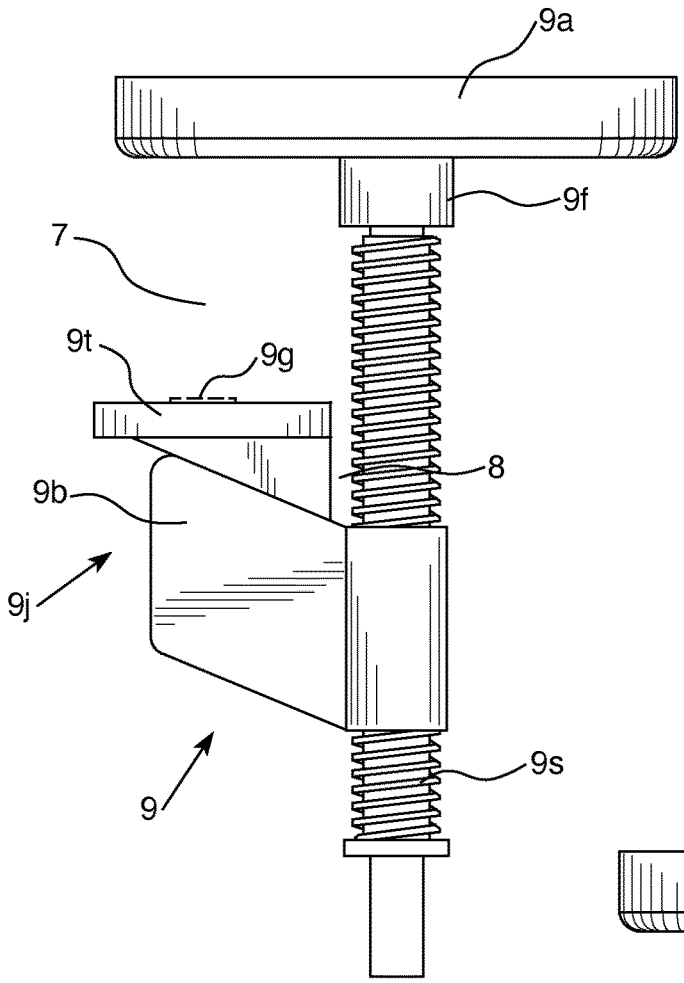
FIG. 6 is a schematic side view of the exemplary embodiment of the work surface attachment mechanism that can be included in the first exemplary embodiment of the article of furniture with the mechanism in the first position.
Figure 7:
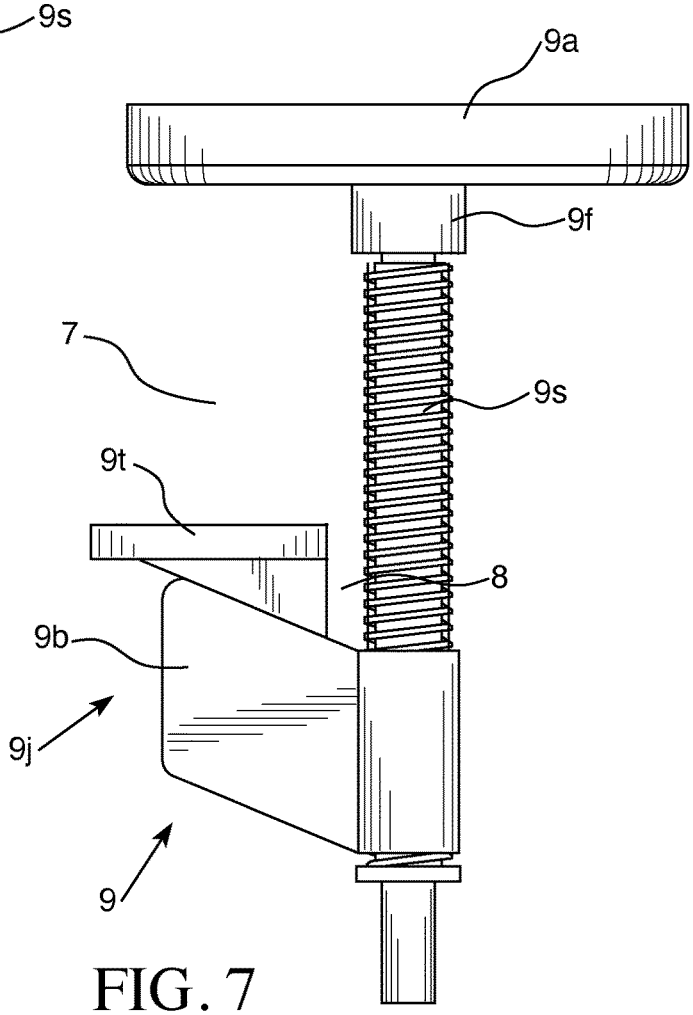
FIG. 7 is a schematic side view of the exemplary embodiment of the work surface attachment mechanism that can be included in the first exemplary embodiment of the article of furniture with the mechanism in a third position.
Figure 8:
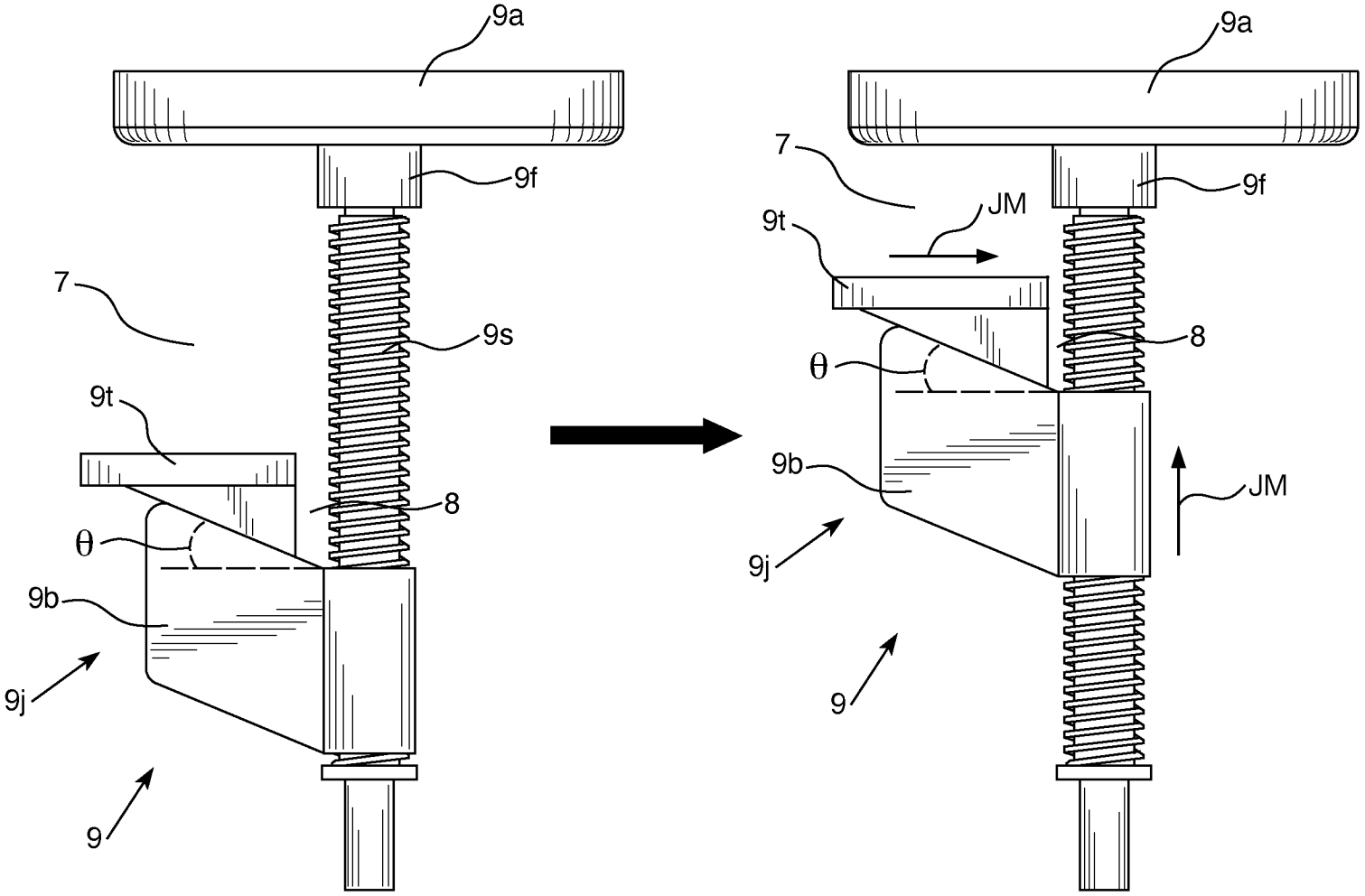
FIG. 8 is a schematic flow chart illustrating an exemplary positional adjustment of the exemplary embodiment of the work surface attachment mechanism that can be provided by the first exemplary embodiment of the article of furniture.

As may be best be appreciated from FIG. 6, the at least one grip element 9*g* shown in broken line can include, for example, at least one elastomeric or rubber element (e.g. rubber sheet, elastomeric plate member) positioned on the upper surface or top surface of the upper clamping member 9*t* that can provide a higher friction surface to help prevent the work surface from sliding or moving after it is within the mouth 7 and is clamped therein via the upper clamping member 9*t* being in its tightened position.

Figure 11:
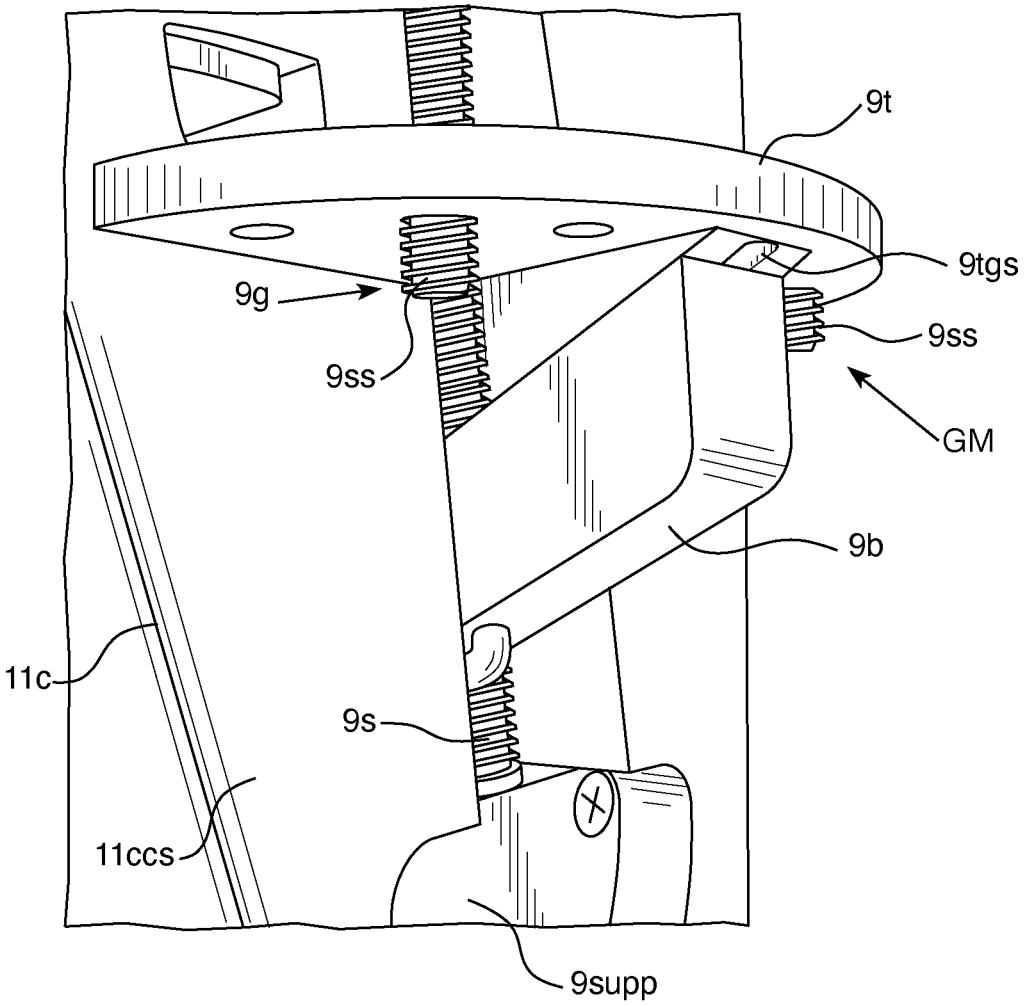
FIG. 11 is a fragmentary perspective view of the exemplary embodiment of the work surface attachment mechanism that can be included in the first exemplary embodiment of the article of furniture with the various components removed to better illustrate an exemplary slot 9*tgs* that can be included as part of the guide mechanism GM that can be utilized in embodiments of the work surface attachment mechanism.
Figure 12:
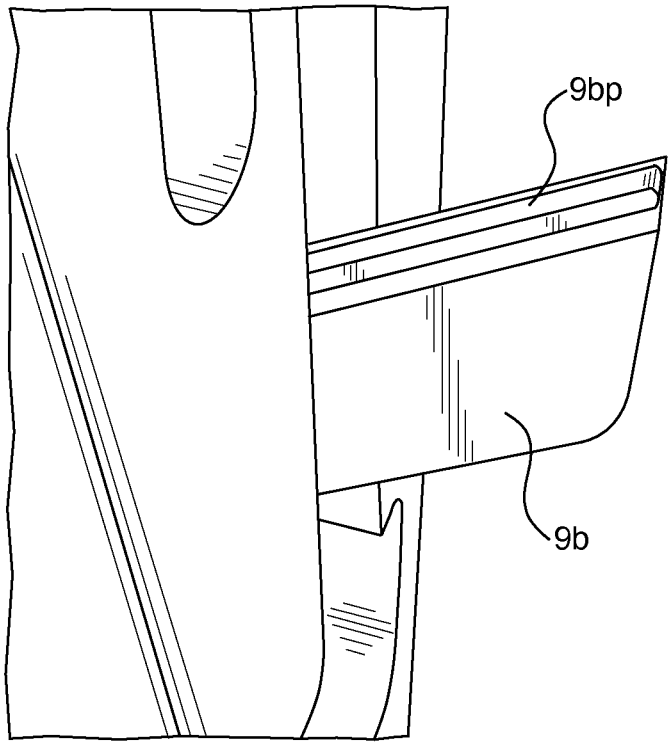
FIG. 12 is a fragmentary perspective view of the exemplary embodiment of the work surface attachment mechanism that can be included in the first exemplary embodiment of the article of furniture with the various components removed to better illustrate an exemplary protrusion 9*bp* that can be included as part of the guide mechanism GM that can be utilized in embodiments of the work surface attachment mechanism.

The at least one grip element 9*g* can also, or alternatively, include one or more set screws 9*ss*. An example of such a configuration may best be seen from FIG. 11. For example, one or more set screws 9*ss* can be passed through holes within the upper clamping member 9*t* for engagement or contact with the work surface 2 or a bottom of the work surface 2. Each set screw 9*ss* can be a bolt, screw, or other type of engagement member that can be passed through the upper clamping member 9*t* so a distal end of the set screw 9*ss* can engage or contact the work surface 2 or the bottom of the work surface 2. In some implementations, the distal end may contact the bottom of the work surface 2. In other implementations, the distal end of the set screw 9*ss* can be driven into the bottom of the work surface 2 so that it bites into the material of the work surface to help provide a secure connection that can avoid slipping or sliding of the work surface. The type and arrangement of grip elements 9*g*, can depend on the material of the work surface and how much friction is induced by the upper clamping member 9*t* engaging the work surface when it is in its tightened position to retain and clamp the work surface 2 within the mouth 7.

Embodiments of the work surface attachment mechanism 5 and article of furniture 1 can be configured for including in a single box having a pre-selected rectangular shape or in multiple boxes that include one box for the work surface 2 and a second box for the components of the base 3 (e.g. legs 3*a*, work surface attachment mechanism(s) 5, etc.). After delivery, an installer can assemble the legs 3*a* to include the work surface attachment mechanisms 5 and, thereafter, couple the outer components 11*a* and upper clamping members 9*t* to the legs 3*a* for adjustment of the size of the mouth 7 and gap 8 for receiving and retaining peripheral edge portions of the work surface 2 for each leg. A tool or the installer's hand can be utilized to rotate the linearly extending elongated member to adjust the position of the jaw 9*j* from an open position to receive a peripheral edge portion of the work surface 2 to a tightened position that clamps that peripheral portion positioned within the mouth 7 via the upper portion of the leg 3*a* and the upper surface of the upper clamping member 9*t*. After the different peripheral edge portions are clamped to the base 3 via the one or more work surface attachment mechanisms 5, the article of furniture can be moved to a desired position on a floor.

For incorporation of the work surface attachment mechanism 5 into each leg 3*a*, an installer can position the linearly extending elongated member 9*s* into the cavity 11*cav* of the leg 3*a* so its lower end is rotatably received into the support 9*supp*. The lower clamping support body 9*b* can be connected to the linearly extending elongated member 9*s* via the tubular portion 9*c* before or after this occurs. Thereafter, the upper body 9*a* can be connected to the upper end 9*send* of the linearly extending elongated member 9*s*. Then the upper clamping member 9*t* can be moveably attached to the ramped upper surface of the lower clamping member support body 9*b*. This can occur before or after the outer casing member 11*a* is attached to the upper clamping member 9*t*. When the upper clamping member 9*t* is attached to the lower clamping support body 9*b*, the projection 11*b* can be positioned within the groove 11*s* of the leg 3*a*. Thereafter, the position of the jaw 9*j* can be adjusted via rotation of the linearly extending elongated member 9*s* as discussed herein. Such rotation can cause the vertical and horizontal motion of the jaw 9*j* (e.g. the upper clamping member 9*t* moving along an upper surface of the lower clamping member support body 9*b* as the vertical position of the jaw 9*j* is changed) as discussed herein.

It should be understood that other modifications to the article of furniture 1 can be made to meet a particular set of design criteria. For example, it is contemplated that a particular feature described, either individually or as part of an embodiment, can be combined with other individually described features, or parts of other embodiments. The elements and acts of the various embodiments described herein can therefore be combined to provide further embodiments. As another example, the work surface of the article of furniture can be an integrally molded or cast structure or can be composed of various separate parts that are fastened and/or adhered together to form the work surface. Therefore, while certain exemplary embodiments of the article of furniture, work surface attachment mechanism, and methods of making and using the same have been discussed and illustrated herein, it is to be distinctly understood that the invention is not limited thereto but may be otherwise variously embodied and practiced within the scope of the following claims.

What is claimed is:

1. A work surface attachment mechanism for an article of furniture, comprising:

a leg, an upper portion of the leg having a component contacting surface defining a cavity;

a linearly extending elongated member rotatably positionable within the cavity;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of a work surface and clamping engagement therewith; and wherein the lower clamping member support body has a tubular portion attached to the linearly extending elongated member or is attached to a tubular portion attached to the linearly extending elongated member.

2. The work surface attachment mechanism for an article of furniture of claim 1, wherein the tubular portion has a threaded channel through which the linearly extending elongated member passes, threads of the linearly extending elongated member mating with threads of the threaded channel so that rotation of the linearly extending elongated member drives motion of the tubular portion along the linearly extending elongated member.

3. A work surface attachment mechanism for an article of furniture, comprising:

a leg, an upper portion of the leg having a component contacting surface defining a cavity;

a linearly extending elongated member rotatably positionable within the cavity;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of a work surface and clamping engagement therewith; and an outer casing member attached to the upper clamping member, the outer casing member having a projection that is slideable within a groove defined in the component contacting surface, the projection being slideable within lower and upper ends of the groove to define a bottom position of the jaw and a top position of the jaw.

4. The work surface attachment mechanism for an article of furniture of claim 3, wherein the jaw includes the outer casing member and the jaw is moveable between the top position and the bottom position without rotating.

5. A work surface attachment mechanism for an article of furniture, comprising:

a leg, an upper portion of the leg having a component contacting surface defining a cavity;

a linearly extending elongated member rotatably positionable within the cavity;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of a work surface and clamping engagement therewith; and wherein the jaw includes a guide mechanism to guide motion of the upper clamping member along the upper surface of the lower clamping member support body.

6. A work surface attachment mechanism for an article of furniture, comprising:

a leg, an upper portion of the leg having a component contacting surface defining a cavity;

a linearly extending elongated member rotatably positionable within the cavity;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of a work surface and clamping engagement therewith; and wherein the upper surface of the lower clamping member support body is ramped at an angle relative to horizontal that is within a pre-selected range of 15°-75°.

7. An article of furniture comprising:

a base;

a work surface supported by the base;

a work surface attachment mechanism comprising:

a linearly extending elongated member rotatably positionable within a cavity of a component of the base;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of the work surface and clamping engagement therewith; and wherein the lower clamping member support body has a tubular portion attached to the linearly extending elongated member or is attached to a tubular portion attached to the linearly extending elongated member.

8. The article of furniture of claim 7, wherein the component of the base is a leg of the base.

9. The article of furniture of claim 7, wherein the work surface is a tabletop or a desktop.

10. The article of furniture of claim 7, wherein the tubular portion has a threaded channel through which the linearly extending elongated member passes, threads of the linearly extending elongated member mating with threads of the threaded channel so that rotation of the linearly extending elongated member drives motion of the tubular portion along the linearly extending elongated member.

11. An article of furniture comprising:

a base;

a work surface supported by the base;

a work surface attachment mechanism comprising:

a linearly extending elongated member rotatably positionable within a cavity of a component of the base;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of the work surface and clamping engagement therewith; and wherein the jaw also comprises:

an outer casing member attached to the upper clamping member, the outer casing member having a projection that is slideable within a groove defined in the component of the base, the projection being slideable within lower and upper ends of the groove to define a bottom position of the jaw and a top position of the jaw.

12. The article of furniture of claim 11, wherein the jaw is moveable between the top position and the bottom position without rotating.

13. An article of furniture comprising:

a base;

a work surface supported by the base;

a work surface attachment mechanism comprising:

a linearly extending elongated member rotatably positionable within a cavity of a component of the base;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of the work surface and clamping engagement therewith; and wherein the jaw includes a guide mechanism to guide motion of the upper clamping member along the upper surface of the lower clamping member support body.

14. An article of furniture comprising:

a base;

a work surface supported by the base;

a work surface attachment mechanism comprising:

a linearly extending elongated member rotatably positionable within a cavity of a component of the base;

a lower clamping member support body moveably attached to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

a jaw comprising an upper clamping member moveably attachable to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of the work surface and clamping engagement therewith; and wherein the upper surface of the lower clamping member support body is ramped at an angle relative to horizontal that is within a pre-selected range of 15°-75°.

15. A method for installing an article of furniture comprising:

providing a work surface, a base, and a work surface attachment mechanism;

positioning a linearly extending elongated member within a cavity of a component of the base so the linearly extending elongated member is rotatable;

attaching a lower clamping member support body to the linearly extending elongated member so that rotation of the linearly extending elongated member in a first rotational direction causes the lower clamping member support body to move upwardly along the linearly extending elongated member and rotation of the linearly extending elongated member in a second rotational direction that is opposite the first rotational direction causes the lower clamping member support body to move downwardly along the linearly extending elongated member;

connecting an upper clamping member of a jaw to the lower clamping member support body so that the upper clamping member is moveably attached to the lower clamping member support body such that upward motion of the lower clamping member support body causes upward motion of the upper clamping member while the upper clamping member also moves along an upper surface of the lower clamping member support body toward the linearly extending elongated member and downward motion of the lower clamping member support body causes the upper clamping member to move downwardly while also moving along the upper surface of the lower clamping member support body away from the linearly extending elongated member, the jaw being moveable to adjust a size of a mouth for receipt of a peripheral edge portion of the work surface and clamping engagement therewith;

moving the jaw to a bottom position for positioning a peripheral edge portion of the work surface in a mouth of the work surface attachment mechanism;

moving the jaw toward a top position to engage the peripheral edge portion of the work surface in the mouth to clamp the peripheral edge portion of the work surface to the component of the base for attachment of the work surface to the base; and wherein the lower clamping member support body has a tubular portion attached to the linearly extending elongated member or is attached to a tubular portion attached to the linearly extending elongated member; and wherein the tubular portion has a threaded channel through which the linearly extending elongated member passes, threads of the linearly extending elongated member mating with threads of the threaded channel so that rotation of the linearly extending elongated member drives motion of the tubular portion along the linearly extending elongated member.

16. The method of claim 15, wherein the component is a leg of the base.

17. The method of claim 16, wherein the work surface is a tabletop or a desktop.

* * * * *